United States Patent [19]

Woods et al.

[11] 4,269,015

[45] May 26, 1981

[54] APPARATUS FOR PACKAGING ARTICLES IN A WIRE-BOUND BOX ASSEMBLY

[75] Inventors: Quentin T. Woods, San Jose; Paul H. Becker, Saratoga; William D. Gerverdinck, San Jose, all of Calif.

[73] Assignee: FMC Corporation, San Jose, Calif.

[21] Appl. No.: 48,415

[22] Filed: Jun. 14, 1979

[51] Int. Cl.[3] ..... B65B 5/02; B65B 11/02

[52] U.S. Cl. ..... 53/526; 53/218; 53/590

[58] Field of Search ..... 53/207, 218, 529, 542, 53/578, 590, 526; 198/772; 414/49, 126

[56] References Cited

U.S. PATENT DOCUMENTS

| | | | |
|---|---|---|---|
| 956,994 | 5/1910 | Peck | 53/218 |
| 1,871,805 | 8/1932 | Parsons et al. | 53/438 X |
| 2,027,010 | 1/1936 | Zeigler | 53/218 |
| 2,066,449 | 1/1937 | Barrett | 53/218 |
| 2,471,062 | 5/1949 | Davis | 198/772 X |
| 2,820,542 | 1/1958 | Oswald | 198/772 |
| 3,006,119 | 10/1961 | Fingerhut | 53/438 |
| 3,443,706 | 5/1969 | Puhm | 414/126 X |
| 3,651,968 | 3/1972 | Cleland | 414/126 X |

*Primary Examiner*—John Sipos

*Attorney, Agent, or Firm*—R. S. Kelly

[57] ABSTRACT

An apparatus for packaging cartons in a wire-bound box assembly includes a folding assembly which supports the unassembled box in a horizontally positioned blank, a shuttle platform which is loaded with a number of cartons and the end boards of the box assembly, a drive mechanism for reciprocatably carrying the loaded shuttle platform to a position above the bottom board of the blank, a stripper assembly including a plate which is downwardly pivotable from a position above the shuttle to a position engaging the ends of the cartons and end boards after the shuttle platform has been moved above the bottom panel, and clamping arms for holding the end boards against the cartons while the shuttle platform is removed. After the stripper plate has been lowered and the clamping arms are in place, the shuttle platform is retracted past the stripper plate such that the end boards and cartons drop onto the bottom panel of the blank. The folding assembly is then actuated to bend the side boards of the blank upwardly and thereafter the top board downwardly so that the wire loops at the top edge of the front side board of the blank can be inserted through the wire loops at the leading edge of the top board thereof to complete the assembly of the box about the cartons.

7 Claims, 7 Drawing Figures

APPARATUS FOR PACKAGING ARTICLES IN A WIRE-BOUND BOX ASSEMBLY

BACKGROUND OF THE INVENTION

1. Field of the Invention

The present invention generally relates to apparatus for packaging an article or articles in a wire-bound box assembly, and more particularly, concerns an improved apparatus for packaging an article or articles in a wire-bound box assembly where the box is assembled about the articles without the use of staples or other fasteners during the box assembly.

2. Description of the Prior Art

In the past, staples or nails have been used to secure the end boards and at least one side board of a wire-bound box assembly to the bottom board thereof prior to the placement of the article or articles to be packaged on the bottom board of the box assembly. For example, in a known automated system for packaging cartons in a wire-bound box assembly, a folding assembly is provided at a first assembly station for initially bending one side board of the box blank upwardly to the vertical. While the box blank is in such configuration, the end boards are stapled to the bottom board and also to the upwardly bent side board. Thereafter, the partially assembled box is conveyed to another assembly station where the articles to be packaged are manually placed on the bottom board. After such placement, the partially assembled box is carried to yet another assembly station for upwardly bending the other of the side boards and for thereafter bending the top board downwardly over the tops of the end boards. The wire loops extending from the upper edge of the first side board are then bent downwardly to interlock corresponding loops at the leading edge of the top board and thus form the final package.

It will be appreciated that the aforementioned initial stapling operation and the realigning operations at the separate assembly stations add considerably to the labor requirements of such prior art wire-bound box packaging operation. Moreover, in order to facilitate storing the foldable box blank and separate end boards for reuse after the articles have been removed from the assembled box, it is necessary to remove the staples securing the end boards to the blank. Such disassembly is not only time-consuming and counterproductive, but also during such disassembly, the box components are sometimes damaged so as to prevent them from being reused.

SUMMARY OF THE INVENTION

The present invention overcomes the problems of the prior art assembly systems by providing an apparatus for packaging articles in a wire-bound box assembly which does not require the use of staples or other temporary securing means to secure the end boards to the blank. Furthermore, all of the steps in the assembly operation are accomplished at a single assembly station.

The apparatus of the present invention includes an assembly for folding a wire-bound box blank around the articles to be packaged and the end boards which have previously been placed at the ends of such articles. A shuttle mechanism is also provided for receiving the articles and end boards in a preassembled configuration suitable for placement on the bottom panel of the blank and for conveying such preassembled configuration to a position directly above and aligned with the bottom board of the blank. A stripper member is moved downwardly to a position adjacent the assembled articles and end boards on the shuttle mechanism, and the shuttle mechanism is retracted to its initial position to permit the stripper mechanism to strip the articles and end boards from shuttle mechanism so that they drop onto the bottom board of the box blank. Opposing clamping arms are provided for holding the end boards against the articles after the shuttle mechanism is removed. The folding assembly is then actuated to bend the side boards upwardly and to thereafter bend the top board downwardly over the top edges of the end boards to thereby fold the box blank completely around the articles and end boards. Upon completion of the folding operation the wire loops of one of the side boards are interlocked with the wire loops at the leading edge of the top board to complete the assembling operation.

DESCRIPTION OF THE PREFERRED EMBODIMENT

Figure 3:
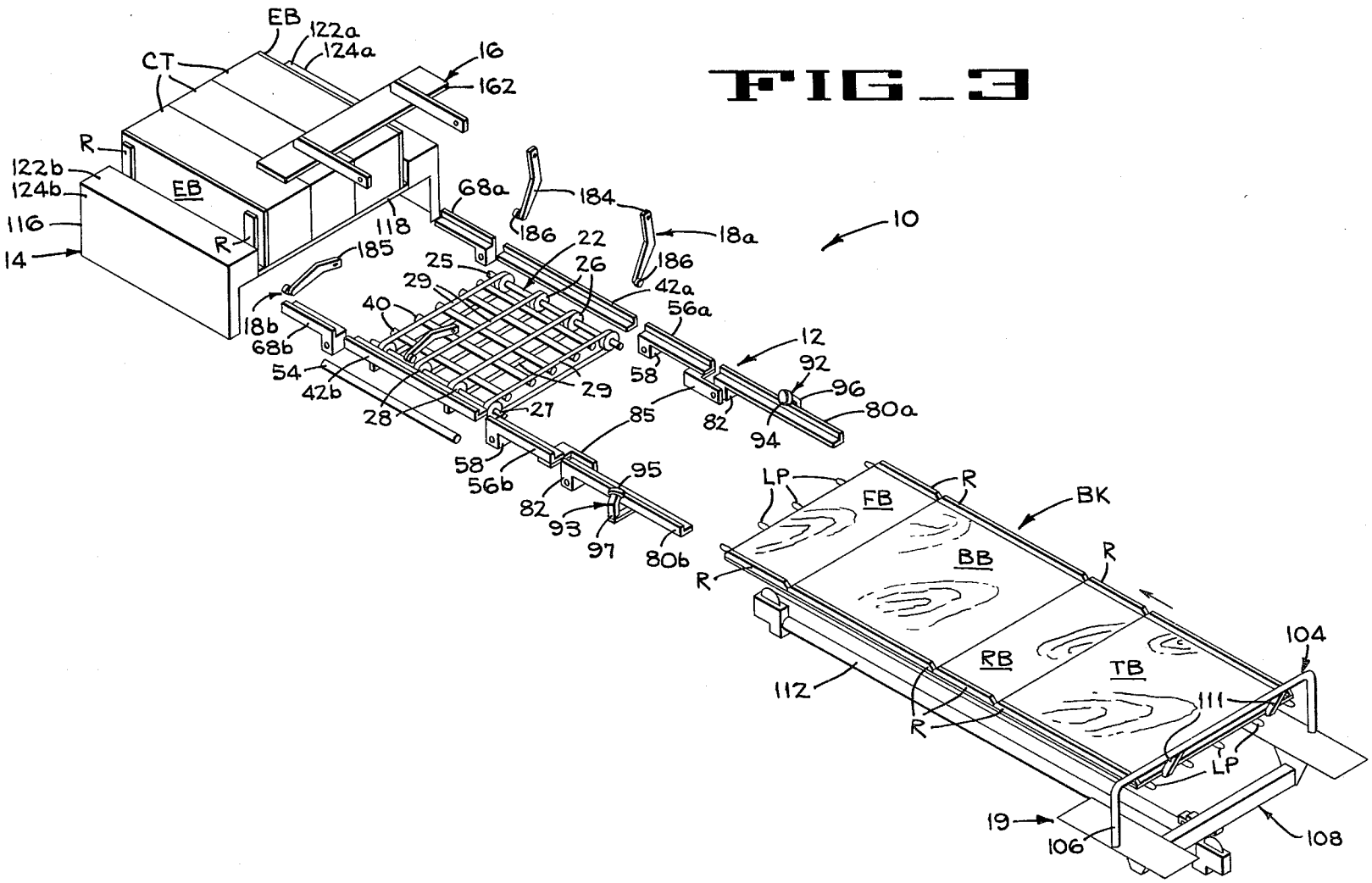
FIG. 3 is a diagrammatic isometric view of the packaging apparatus of the present invention illustrating the initial arrangement of the basic components with the cartons and end boards being assembled on the shuttle platform and with a wire-bound box blank being positioned on the table of the feeder assembly.

Referring now more particularly to FIG. 3, it will be seen that an apparatus 10 is provided for packaging three cartons CT in a wire-bound box assembly. The apparatus generally includes a folder assembly 12 for folding a wire-bound box blank BK around the preassembled cartons CT and end boards EB and a shuttle assembly 14 for maintaining the cartons and the end boards in an assembled arrangement suitable for encasement by the blank BK and for carrying such assembled arrangement to a position directly above the bottom board BB of the box blank BK when the box blank is supported in the folder assembly 12. The apparatus 10 further includes a stripper assembly 16 for stripping the cartons and end boards from the shuttle assembly 14 as the latter is retracted from its position above the bottom board. A pair of opposing, conjointly operable, clamp arm assemblies **18*a* and 18*b* are also provided for holding the end boards against the cartons as they both are stripped from the shuttle assembly 14 and dropped onto the bottom board of the box blank. To facilitate rapid production rates, the packaging apparatus 10 also includes a feeder assembly 19 for initially positioning the flat box blank BK on the folder assembly 12 and a discharge conveyor 22** mounted below the folder assembly to receive the assembled box from the folder assembly and deliver it laterally of the apparatus to a take-away conveyor (not illustrated).

As best shown in FIG. 3, the wire-bound box blank BK is a conventional foldable blank consisting of a first side board FB, the bottom board BB which is connected by strands of wire WR (FIGS. 6 and 7) to the side board FB, a second side board RB which is connected to the bottom board by the wires WR, and a top board TB connected the side board RB by the wires WR. In accordance with the particular direction in which the blank is fed to the folder assembly 12 by the feeder assembly 19, the first side board FB will be hereinafter referred as the front side board, and the second side board RB will be referred to as the rear side board. The wires WR (comprising five in number) generally uniformly spaced across the blank and are stapled to the boards forming the blank. Loops LP are formed by the projecting ends of the wires at the ends of the box blank so that after the blank has been folded, the leading edge of the top board TB and the upper edge of the front side board FB may be secured to each other by inserting the wire loops extending upwardly from the front side board through the loops extending from the top board and thereafter bending the former loops outwardly and downwardly. Ribs R (FIG. 3) are attached to the inside faces of the boards of the blank adjacent the side edges thereof, and further ribs R are fastened to the outside faces of the end boards EB adjacent the side edges thereof, all of the various ribs being utilized to provide a rigid support frame when the box is assembled.

As will be seen in the Drawings, the three cartons CT are packaged side-by-side with their combined dimensions generally being the same as the finished box assembly so as to fit tightly therein.

Figure 1:
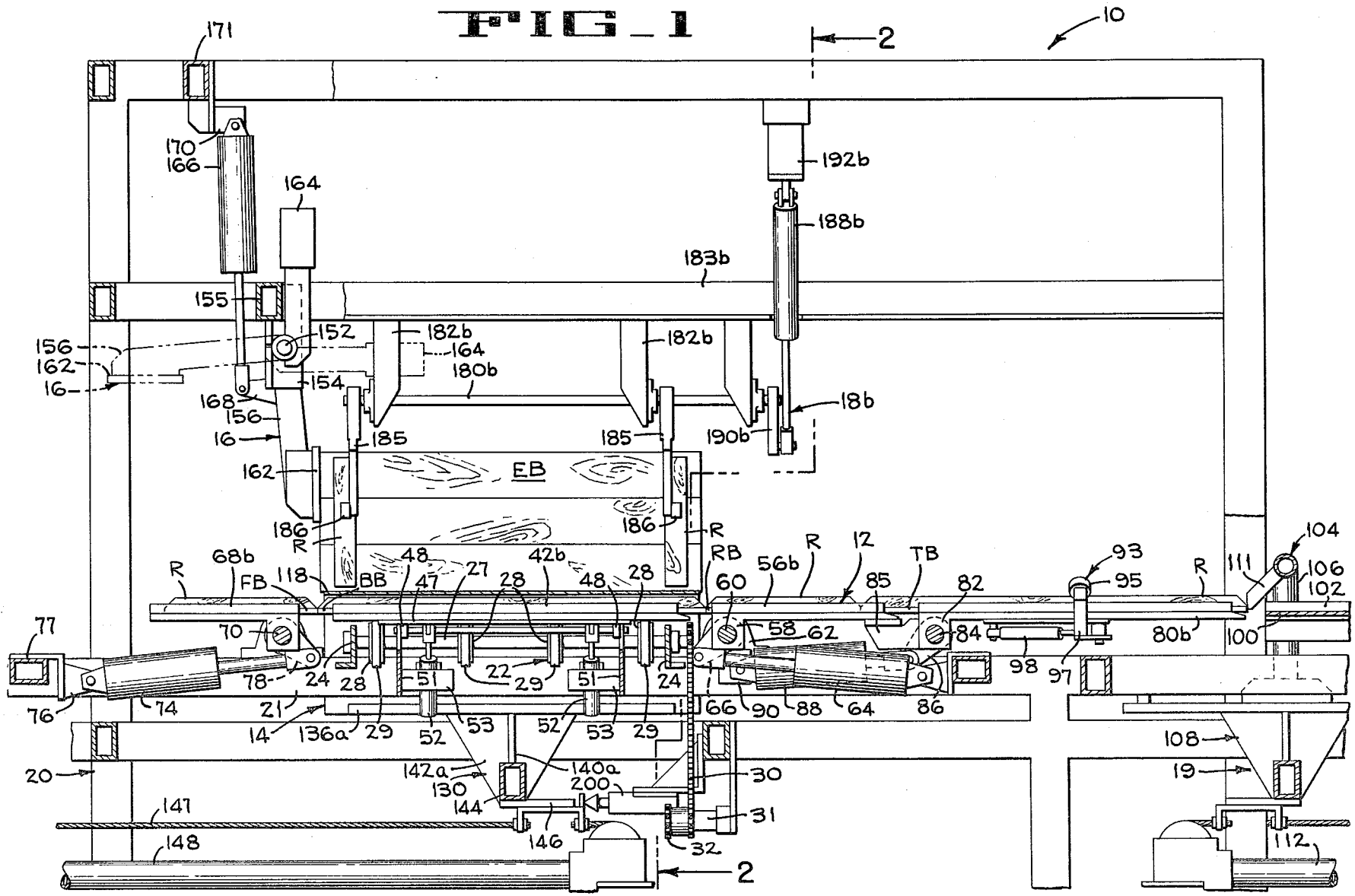
FIG. 1 is a section taken on line 1—1 of FIG. 2 which illustrates the packaging apparatus of the present invention with the initial (non-stripping) position of the stripper plate mechanism being illustrated in phantom lines.
Figure 2:
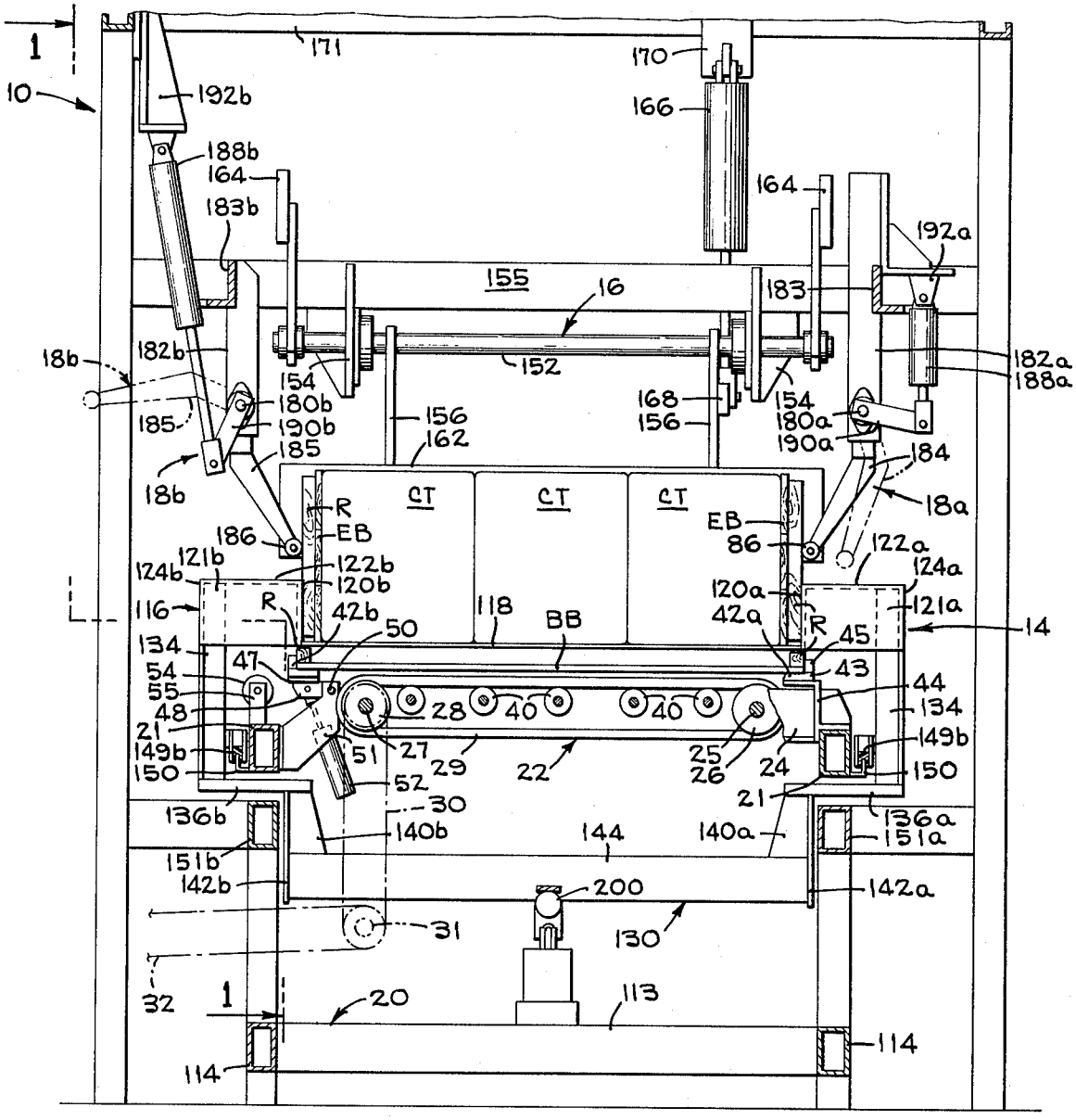
FIG. 2 is a section taken on line 2—2 of FIG. 1 with the initial (non-supporting) positions of the opposing clamping arms being depicted in phantom lines.

As previously stated, a discharge conveyor 22 is provided for conveying the finished box assembly from the folder assembly 12. The conveyor 22 is supported by side angles 24 (FIG. 1) which are connected between opposed, longitudinally extending channels 21 (FIG. 2) of a support framework 20. An idler shaft 25 (FIG. 2) is mounted by suitable bearings between the side angles 24 adjacent one side of the framework 20 and has four pulleys 26 equally spaced thereon. A drive shaft 27 also having four pulleys 28 thereon is mounted by suitable bearings between the side angles 24 adjacent the opposite side of the framework 20. Four endless drive belts 29 are entrained on the aligned pulleys 26 and 28. A plurality of elongated support rollers 40 (FIG. 2) are mounted in spaced positions between the drive and idler shafts of the belt conveyor for supporting the upper reaches of the drive belts 29. A drive chain 30 (diagrammatically shown in FIG. 2) is entrained on a sprocket affixed to one end of the drive shaft 27 and is also entrained about a sprocket mounted on a shaft 31 (FIG. 2). The shaft 31 is driven by a chain 32 (diagrammatically illustrated) which is driven in synchronization with a take-away conveyor (not illustrated) extending from the discharge end of the conveyor 22. The take-away conveyor is adapted to receive assembled boxes from the folder assembly 12 and deliver them to a conventional stacking or loading mechanism.

As seen in FIG. 3, the folder assembly 12 generally includes four opposed pairs of folding rails 42*a* and 42*b*, 56*a* and 56*b*, 68*a* and 68*b*, and 80*a* and 80*b*. These four pairs of rails are aligned at opposite sides of the apparatus and are initially maintained in a horizontal plane so that the box blank BK may be fed thereto along the plane of the rails. After the assembled carton CT and end boards EB are dropped onto the bottom board BB, as will be hereinafter described, the pairs of folding rails are pivoted, in sequence, to fold the front side, rear side and top boards therearound.

The first opposed pair of rails 42*a* and 42*b* support the bottom board BB of the box blank during the folding operation. The rail 42*a*, is horizontally and stationarily disposed in a position which is vertically offset above the rear end of the discharge conveyor 22, that is, at the right side (FIGS. 2 or 3) of the folder assembly 12. The angle-shaped rail 42*a* includes a flat, horizontally oriented bar 43 (FIG. 2) mounted by a pair of brackets 44 (one only shown in FIG. 2) to a longitudinally extending channel 21 of the support framework 20. The rail 42*a* further includes an upstanding nylon guide strip 45 attached to the top flat surface of the bar 43 adjacent the outer edge thereof. As best illustrated in FIG. 2, the opposing horizontal rail 42*b* is pivotally mounted to the support framework 20 adjacent the drive shaft 27 of the discharge conveyor 22 so as to lie parallel to the rail 42*a*. The rail 42*b* is initially positioned in horizontally aligned relationship with the stationary rail 42*a* to thereby support the box blank BK in a horizontal plane. After the blank folding operation has been completed, the rail 42*b* is arranged to be downwardly pivoted to lower the box assembly supported thereby onto the discharge conveyor 22. The rail 42*b* is of a similar construction to the rail 42*a* (as seen in FIG. 2) and includes an upstanding nylon guide strip attached to a flat bar, with the distance between the nylon guide strips of the two opposing rails 42*a*, 42*b* being only slightly greater than the width of the box blank BK. The flat bar of the pivotable rail 42*b* is mounted to a support bar 47, and the bar 47 is supported by a pair of support arms 48. The support arms 48 are secured to a shaft 50, and the shaft 50 is rotatably supported by a pair of brackets 51 which are connected to the adjacent longitudinally extending channel 21 of the support framework. The movement of the pivotable rail 42*b* is controlled by a pair of hydraulic cylinders 52 which are operatively connected between the bar 47 and a pair of brackets 53 (FIG. 1) which are mounted to the brackets 51. As will be hereinafter described, after a box assembly has been formed, the pistons of cylinders 52 are retracted to cause the rail 42*b* to pivot about the axis of the shaft 50 to lower the corner of the box assembly supported on the rail 42*b* onto the discharge conveyor 22. The discharge conveyor is operated through the drive connection shown to carry the completed box assembly off of the stationary rail 42*a* and out of the apparatus. To assist in the transferring of the completed box assembly to the discharge conveyor, a support roller 54 (FIG. 2) is mounted by a pair of brackets 55 to the support frame channel 21 at a position disposed outwardly of the pivotable rail 42*b*.

As illustrated in FIG. 3, the pair of parallel rails 56*a* and 56*b* of the folder assembly are arranged upstream of the rails 42*a* and 42*b* for folding the rear side board RB of the box blank upwardly to a vertical position. Each rail 56*a*, 56*b* is similar to the rails 42*a*, 42*b* in that it contains an upright guide portion and a flat track portion for receiving the side edges of the box blank BK. However each rail 56*a*, 56*b* also has a depending bracket portion 58 formed at the leading end thereof which is rigidly engaged upon a shaft 60 (FIG. 1) extending across the folder assembly. The shaft 60 is received within bearings 62 (FIG. 1) attached to the longitudinally extending channels 21 of the support frame. The shaft 60 is selectively rotated by a hydraulic cylinder 64 which is coupled to the shaft by a lever arm 66. When the cylinder 64 is extended (as shown in FIG. 1) the rails 56*a*, 56*b* will be in a horizontal orientation aligned with the rails 42*a*, 42*b*. After the end boards and cartons have been positioned on the bottom board BB of the box blank, the cylinder 64 is arranged to be retracted to fold the rear side board RB upwardly against the end boards EB and to hold such board RB in such position until the front board FB and the top board TB have been folded to completely encase the end boards, as will be hereinafter described.

As further illustrated in FIG. 3, the pair of rails 68*a* and 68*b* for initially receiving and thereafter upwardly folding the front side board FB of the box blank are of the same general construction as the rails 56*a*, 56*b* and are mounted for pivotal movement about the axis of a shaft 70 (FIG. 1) which is positioned across the folder assembly adjacent the front end of the rails 42*a*, 42*b*. The rails 68*a*, 68*b* are pivoted by a hydraulic cylinder 74 (FIG. 1) which is connected between a bracket 76 mounted to a transversely extending channel 77 of the support frame and a lever arm 78 which is secured to the shaft 70, the shaft 70 being rotatably mounted in bearing blocks attached to the support frame channels 21. The cylinder 74 is initially extended to orient the rails 68*a*, 68*b* in a horizontal plane aligned with the rails 42*a*, 42*b* and is arranged to be subsequently retracted to pivot the rails 68*a*, 68*b* upwardly to the vertical thereby folding the front board FB of the blank against the front edges of the end boards and cartons supported on the bottom board of the blank.

The fourth set of rails 80*a* and 80*b* are pivotally mounted to the upstream ends of the rails 56*a* and 56*b*, respectively, so as to extend initially in a horizontal plane aligned with the rails 42*a*, 42*b*. Thus, when the rails 56*a* and 56*b* are pivoted upwardly to a vertical position the rails 80*a* and 80*b* are also elevated into a vertical orientation above the cartons CT on the box blank. After the rails 56*a*, 56*b* have been fully pivoted upwardly to fold the rear side board RB to a vertical position, the rails 80*a*, 80*b* are pivoted downwardly to bend the top board TB against the top edges of end boards and the top surfaces of the cartons. Each of the rails 80*a*, 80*b* is of essentially the same construction as the rails 56*a*, 56*b* and includes transversely spaced, longitudinally extending nylon guide bars which are aligned with the guide bars of the other rails and flat supporting surfaces for slidably supporting the side edges of the box blank. In order to permit the bending motion of the rails 80*a* and 80*b*, each of such rails is provided with a depending bracket portion 82 at its forward end which is fixed to a transversely extending shaft 84 (FIG. 1). The shaft 84 is received within bearings mounted to brackets 85 (FIG. 3) which extend inwardly from the upstream ends of the rails 56*a*, 56*b*. A lever arm 86 (FIG. 1) is rigidly attached to the shaft 84, and a hydraulic cylinder 88 is operatively connected between the lever arm 86 and a bracket 90 which is affixed to the shaft 60 upon which the bending rails 56*a*, 56*b* are secured. It will be recognized therefore, that when cylinder 64 elevates the rails 56*a* and 56*b*, the cylinder 88 will provide a rigid connection between rails 56*a*, 56*b* and rails 80*a*, 80*b* to also elevate the latter. Subsequent activation of the cylinder 88 to extend the piston thereof will cause the lever arm 86 to pivot rails 80*a* and 80*b* back to a horizontal orientation.

The three pivotable sets of rails 56*a* and 56*b*, 68*a* and 68*b*, and 80*a* and 80*b* are initially horizontally aligned with the rails 42*a* and 42*b* as shown in FIG. 3. In such orientation the upstream ends of the rails 80*a* and 80*b* are closely spaced from and aligned with the discharge end of a table 100 of the feeder assembly 19 (hereinafter described), thereby enabling the box blank BK to be slid onto the aligned rails by the feeder assembly.

To hold the top board TB to the rails 80*a*, 80*b* when the box blank is being folded, clamp roller assemblies 92 and 93 are attached to the rails 80*a* and 80*b*, respectively. As illustrated in FIGS. 1 and 3, the clamp roller assemblies 92 and 93 include angled brackets 96 and 97, respectively, each bracket being pivotally connected to the respective rail for rotation about an axis which is perpendicular to flat bar element of the rail (FIG. 1). Rollers 94 and 95 are rotatably mounted on pins extending inwardly from the outer end of each bracket 96 and 97, respectively. The brackets 96 and 97 are pivoted by hydraulic cylinders 98 (only one being shown in FIG. 1) mounted between the outer ends of the brackets and swivel connections underlying the associated rails. The cylinders 98 of the clamping roller assemblies are initially extended to position the rollers 94 and 95 outwardly from the guide rails 80*a*, 80*b*. After the box blank BK has been positioned on the rails of the folder assembly, the cylinders 98 are concurrently retracted to force the opposing rollers against the outside edges of the ribs R are of the top board TB of the blank (as seen in FIG. 1). In this manner, the top board of the blank is held against the rails 80*a*, 80*b* as the rails 56*a*, 56*b* are pivoted upwardly so as to fold the rear board RB and top board TB to a vertical position and, thereafter, while the rails 80*a*, 80*b* are pivoted relative to the rails 56*a*, 56*b* to fold the top board downwardly to the horizontal. The rollers 94 and 95 firmly engage the ribs R of the top board to hold the board in place, but they are capable of rotating to permit the top board to move longitudinally with respect to the rails. The clamp roller assemblies thus assure that the box blank is accurately folded so that the ribs of the top and rear boards of the box blank come into proper engagement with the ribs of the end boards EB and also that the wire loops LP of the top board and front board FB intermesh when the top board is folded downwardly.

Although the flat box blank BK may be manually positioned on the horizontally positioned rails of the folder assembly 12, the feeder assembly 19 is provided to rapidly and accurately transfer the blank to the folder assembly 12. Referring to FIG. 1, the feeder assembly 19 will be seen to include a table or platform 100 which is horizontally aligned with the rails of the folder assembly. A pair of nylon guide strips 102 (one only shown in FIG. 1) are fastened at the side margins of the table 100 in alignment with the nylon guide strips of the folding rails of the folder assembly. The feeder assembly 19 further includes a pusher assembly 104 (FIGS. 1 and 3) for pushing the box blank onto the rails of the folder assembly. The pusher assembly 104 includes an inverted U-shaped tubular member 106 which includes a horizontal upper portion extending transversely above the table 100 and vertical leg portions, the lower ends of the leg portions being mounted upon the laterally projecting sides of an undercarriage 108. The undercarriage 108 is slidably and reciprocably received on a pair of tracks (not shown). The undercarriage and tracks of the feeder assembly are substantially similar to the undercarriage and tracks of the shuttle assembly 14, which will be hereinafter described; and thus, reference may be made to the later more complete description of the shuttle assembly for a further understanding of the construction of the undercarriage 108 and its associated tracks. A pair of transversely spaced lugs 111 (FIG. 3) extend downwardly from the horizontal portion of the tubular member 106 to a depth suitable for engaging the trailing edge of the top board TB of the box blank supported on the table 100. A cable cylinder 112 is provided for pulling the undercarriage 108 toward the folder assembly 12 to thereby push the blank onto the rails of the folder assembly. The cable cylinder 112 is suitably supported upon the support framework 20 and the undercarriage 108 is connected to the cable cylinder as shown in FIG. 1 so that the pusher assembly 104 can be moved from one end of support table 100 to the other to feed the box blank.

Having described the folder assembly 12 and the associate feeder assembly 19, the shuttle assembly 14 for feeding the assembled articles to be packaged will now be described in connection with FIGS. 1–3. The shuttle assembly will be seen to include a contoured platform 116 which is fabricated from sheet metal. The platform 116 includes a flat rectangular bottom wall 118 and longitudinally extending, vertical side walls 120*a* and 120*b* at the side margins of the bottom wall 118. The width of the bottom wall 118, that is, the distance between the side walls 120*a*, 120*b*, is slightly greater than the combined width of the three cartons CT and the end boards EB. The length of the bottom wall and side walls is generally equal to the length of the cartons and end boards. As illustrated in FIG. 3, the cartons are placed side-by-side on the platform with the ends thereof being coterminous with the open ends of the platform, and thereafter the end boards are inserted between the side walls 120*a*, 120*b* and the cartons. In this manner, the cartons and end boards are suitably arranged for placement on the bottom board BB of the box blank and subsequent encasement in the blank. The contoured platform 116 also includes top walls 122*a* and 122*b* (FIG. 3) extending horizontally from the side walls 120*a* and 120*b*, respectively, and outside walls 124*a* and 124*b* extending vertically downwardly from the outer edges from the top walls 122*a* and 122*b*, respectively. To reinforce the fabricated platform, end walls 121*a* and 121*b* (FIG. 2) are formed transversely between the side walls, top walls, and outside walls at the respective sides of the platform. The top walls and outside walls provide smooth surfaces against which an operator may safely lean while placing the cartons and end boards on the platform.

The undercarriage 130 (FIGS. 1 and 2) of the shuttle assembly 14 includes aligned pairs of downwardly extending posts 134 (two only shown in FIG. 2) which are attached to the inner walls of the contoured platform 116. A flat elongate plate 136*a* is secured to the bottom ends of the vertical posts 134 at one side of the undercarriage to extend inwardly therefrom in a horizontal plane, and a similar plate 136*b* is secured in the same manner to the posts 134 at the other side of the undercarriage. A pair of braced support structures, consisting of longitudinally extending triangular plates 140*a*, 140*b* and transversely extending gusset plates 142*a*, 142*b*, extend downwardly from the opposing inner ends of the plates 136*a* and 136*b*, respectively. A channel 144 is connected between the opposed bottom ends of the plates 140*a*, 140*b* and 142*a*, 142*b* so as to extend transversely beneath the platform 116. A bracket 146 (FIG. 1) is connected to the center of the channel 144, and the cables 147 of a cable cylinder 148 are connected to the bracket 146 as shown (FIG. 1). As seen in FIG. 2, the undercarriage is slidably supported by longitudinally extending channels attached to the inner sides of the posts 134 (FIG. 2) which are arranged to be received upon nylon track blocks 149*b* which are mounted on brackets 150 connected to the channels 21 of the support framework 20. As seen in FIG. 2, the rectangular plates 136*a*, 136*b* of the undercarriage extend through openings formed between the longitudinally extending channels 21 and a lower pair of longitudinally extending channels 151*a*, 151*b* of the support framework 20.

A conventional shock absorber (not illustrated herein) is provided for stopping the undercarriage 130 at the position (FIG. 3) spaced outwardly from the folder assembly 12 where the cartons CT and end boards EB may be loaded on the shuttle platform. Another stop device 200 (FIG. 1) with shock absorber is provided for stopping the longitudinal movement of the undercarriage 130 in the delivery position such that the shuttle platform 116 and the cartons CT thereon are centered above the rails 42*a* and 42*b* of the folder assembly 12. The platform 116 is then in a position where the end boards and cartons may be directly dropped onto the bottom board BB of the box blank.

Figure 4:
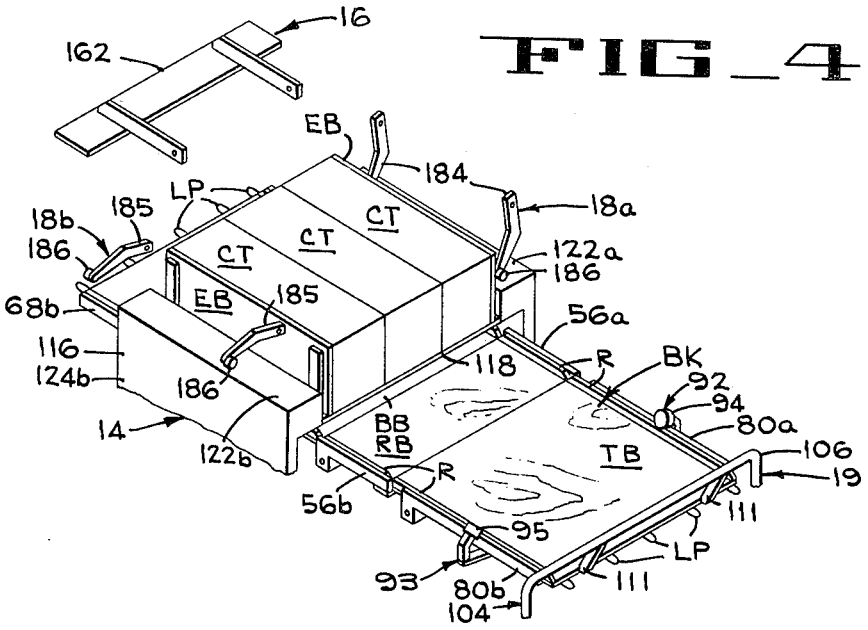
FIGS. 4–7 are diagrammatic isometric views which illustrate the sequence of steps comprising the operation of the packaging apparatus of the present invention.
Figure 5:
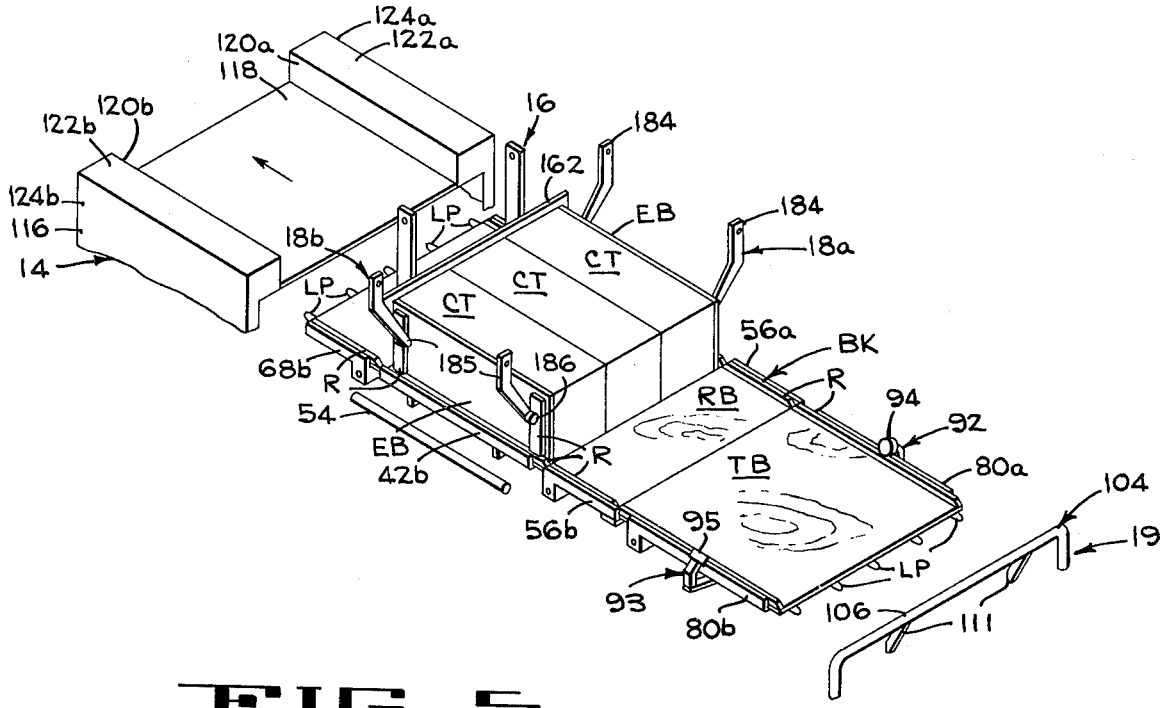
Figure 6:
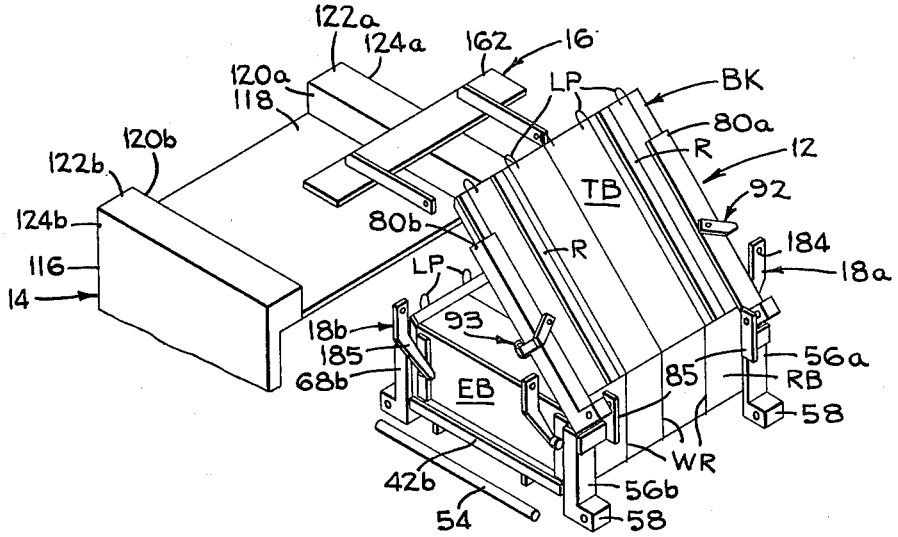
Figure 7:
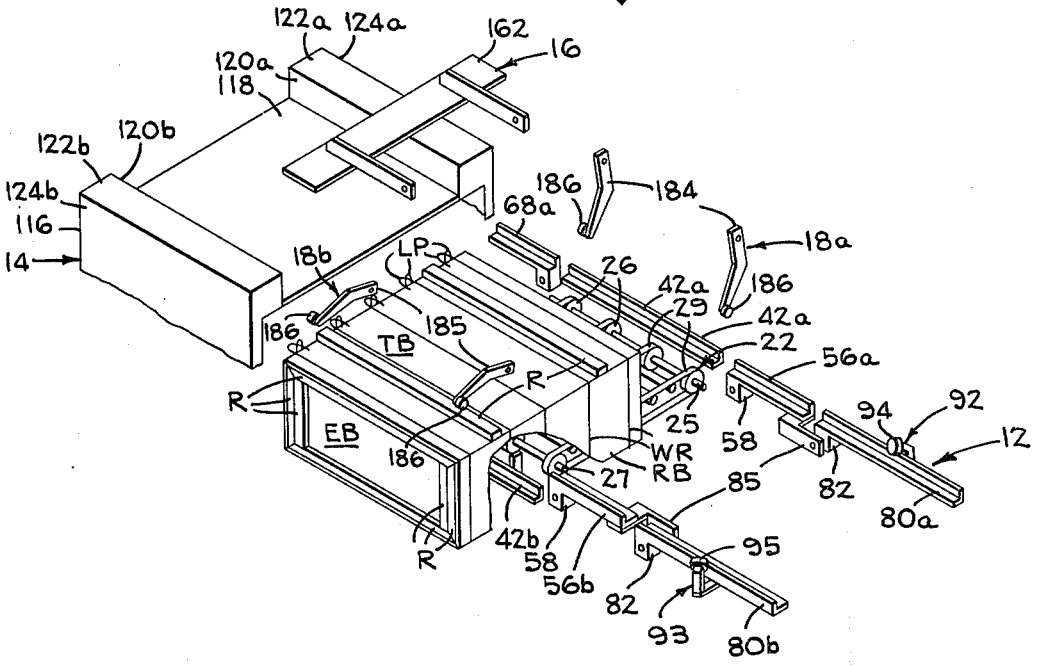

As previously stated, the stripper assembly 16 is provided for stripping the cartons CT and end boards EB from the shuttle assembly 14 as the latter is returned to its loading position. As illustrated in FIGS. 1 and 2, the stripper assembly is mounted to the support framework 20 above the front ends of the rails 42*a*, 42*b*. It includes a transversely extending shaft 152 (FIG. 2) which is supported for rotation about its axis by bearings attached to a pair of spaced brackets 154 which, in turn, depend from a transversely extending channel 155 of the support framework. A pair of projecting arms 156 is rigidly attached to the shaft 154, and a stripper plate 162 is mounted to the outer ends of the arms 156. A counterweighted arm 164 is attached to each end of the shaft 152 (FIG. 2). A hydraulic cylinder 166 is operatively connected between a crank arm 168 (FIG. 1) extending perpendicularly from one of the arms 156 and a bracket 170 which extends downwardly from a transversely extending channel 171 at the top of the support framework. The piston of cylinder 166 is initially retracted so as to hold the stripper plate 162 in an elevated position and in a generally horizontal orientation, as shown in FIGS. 4, 6 and 7 and in phantom lines in FIG. 1. In such elevated position the stripper plate will be clear of the cartons CT and end boards EB on the shuttle assembly 14 as the shuttle assembly moves them to a position centered above the rails 42*a*, 42*b* of the folder assembly. The piston of cylinder 166 is thereafter extended to downwardly pivot the stripper plate 162 to a vertical position (FIGS. 1 and 5) in abutment with the ends of the cartons and end boards whereby the stripper plate will be vertically aligned with the end of the bottom board BB (FIG. 1). The cable cylinder 148 of the shuttle assembly may then be actuated to return the shuttle platform 116 to its initial, loading position. As the shuttle platform is retracted, the stripper plate 162 restrains the movement of the cartons and end boards and thereby strips the same from the platform of the shuttle assembly, as illustrated diagrammatically in FIG. 5.

The remaining components of the packaging apparatus are the conjointly operable, clamping arm assemblies 18*a* and 18*b* arranged at each side of the apparatus which firmly hold the end boards EB and cartons CT in a tight arrangement as they drop from the shuttle platform 116 onto the bottom board BB of the box blank and which maintain the cartons and end boards in such tight arrangement until the box blank is completely assembled about them. The clamping arm assemblies 18*a* and 18*b* each include a longitudinally extending shaft 180*a*, 180*b* which is received for rotation within a pair of bearings affixed to brackets 182*a*, 182*b* that extend downwardly from longitudinally extending rails 183*a*, 183*b* of the support framework (FIGS. 1 and 2). It will be seen from FIG. 2 that the shafts 180*a* and 180*b* are mounted outwardly of the rails 42*a* and 42*b*, respectively. Two laterally spaced, depending clamping arms 184, 185 are respectively fixed to each of the shafts 180*a* and 180*b* at positions which are aligned with the upstanding ribs R on the end boards EB when they are positioned above the rails 142*a*, 142*b*. Rollers 186 are mounted for free rotation at the lowermost ends of all of the clamping arms.

The shafts 180*a* and 180*b* are arranged to be conjointly rotated by cylinders 188*a* and 188*b*, respectively, to pivot the pairs of clamp arms 184 and 185 inwardly toward each other (see FIG. 2). The pistons of the cylinders 188*a* and 188*b* are pivotally coupled to the ends of lever arms 190*a* and 190*b*, respectively, which are respectively fixed to the ends of the shafts 180*a* and 180*b*. The cylinder members of the cylinders 188*a* and 188*b* are pivotally connected to brackets 192*a* and 192*b*, respectively, which are mounted to the overlying support framework as shown in FIG. 2. The arms 185 of the clamping arm assembly 18*b*, which are positioned over the discharge end of the discharge conveyor 22, are initially oriented in a generally horizontal orientation (phantom lines in FIG. 2) and are pivoted downwardly into a generally vertical orientation to engage the end board which is supported on the platform 116 of the shuttle assembly. The arms 184 of the clamping arm assembly 18*a*, which are positioned over the upstream end of the discharge conveyor 22, are initially held by the cylinder 188*a* in a generally vertical orientation (shown in phantom lines in FIG. 2) and are pivoted inwardly only by a small amount to place them in engagement with the adjacent end board EB. The opposing pairs of clamping arms 184 and 185 are simultaneously inwardly pivoted, with the rollers 186 at the ends of the clamping arms being conjointly pressed against the ribs of the end boards to thereby firmly hold the end boards against the cartons. When the shuttle assembly 14 is actuated to withdraw the shuttle platform 116 from under the end boards and cartons, as shown in FIG. 5, the end boards and cartons will drop as a unit onto the bottom board BB supported on the folder assembly. It will be appreciated that the rollers 186 of the clamping arm assemblies will apply sufficient pressure to keep the arrangement of end boards and cartons firmly together while yet permitting the end boards to be readily carried downwardly with the cartons onto the bottom board. The clamping arm assemblies then remain in their clamping positions until after the box blank has been completely assembled.

Having thus described the construction of a preferred embodiment of the packaging apparatus 10, a brief description of the operation of this apparatus will now be set forth. As shown in FIG. 3, a flat box blank BK is placed on the table 100 of the feeder assembly 19. While the platform 116 of the shuttle assembly 14 is in its initial position spaced from the rails 68*a* and 68*b* (FIG. 3), the three cartons CT are placed side-by-side on the platform and the end boards EB are inserted between the side walls of the platform 116 and the sides of the adjacent cartons.

Next, the cable cylinder 112 is activated and the blank BK is pushed by the pusher assembly 104 (as indicated by the arrow in FIG. 3) from the table 100 onto the horizontally aligned rails 80*a* and 80*b* of the folder assembly 12 until the bottom board BB thereof is centered over the rails 42*a* and 42*b*. This latter position of the blank is best shown in FIG. 1. The hydraulic cylinders 98 are thereafter actuated to pivot the brackets of the clamp roller assemblies 92 and 93 inwardly to engage the rollers 94 and 95 thereof against the ribs R of the top board TB (FIG. 4) to hold it against the rails 80*a*, 80*b*. The cable cylinder 112 can then be reversed to retract the feeder assembly to its initial position.

Next, the cable cylinder 148 is actuated, and, as shown in FIG. 4, the loaded platform 116 of the shuttle assembly 14 is moved over the box blank BK to a position centered above the bottom board BB, that is, to a position aligned with the folding rails 42*a* and 42*b* of the folder assembly 12. While the shuttle assembly is in this position and as shown in FIG. 1, the cylinder 166 is actuated and the plate 162 of the stripper assembly is pivoted from its initial horizontal position to a vertical position in abutment with the end boards and cartons. Simultaneously therewith the cylinders 188*a* and 188*b* are actuated and the clamping arms 184 and 185 of the clamp arm assemblies 18*a* and 18*b* are pivoted from their outwardly extended positions to positions (illustrated in FIGS. 2 and 5) where the rollers 186 at the ends thereof engage the ribs R of the end boards to thereby firmly press the end boards against the cartons.

As illustrated in FIG. 5, the cylinder 148 is then reversed and the platform 116 of the shuttle assembly is withdrawn to its initial loading position; and upon such withdrawal, due to the abutment of the stripper plate 162 with the end boards and cartons, the cartons and end boards are stripped from the platform 116 and are caused to drop onto the bottom board BB of the box blank. The rollers of the clamping arms 184 and 185 both exert sufficient force on the end boards during their downward movement to assure that the bottom edges of the end boards fall within the ribs of the bottom board BB where the ribs of the end boards will abut against the ribs of the bottom board. The clamping arms 184, 185 are then maintained in such downwardly pivoted orientations to hold the end boards in place against the cartons during the later assembly of the box blank.

The piston of cylinder 166 is next retracted to raise the stripper plate 162 to its initial horizontal orientation (FIG. 6). Then, the cylinder 74 is actuated to pivot the rails 68*a* and 68*b* of the folder assembly 12 upwardly and thereby fold the front side board FB upwardly such that the ribs thereof generally abut against the adjacent ribs on the end boards (FIG. 6). Simultaneously, the rails 56*a* and 56*b* are pivoted upwardly to the vertical by actuating the cylinder 64 to thereby fold the rear side board RB up against the end boards and to raise the top board TB to a vertical orientation. After the rear side board RB and top board TB have been folded to the vertical, the rails 80*a* and 80*b* are driven downwardly by the actuation of cylinder 88 such that the ribs of the top board abut against the top ends of the ribs on the end boards, as shown in FIGS. 6 and 7.

As the interconnected pairs of rails 56*a*, 56*b* and 80*a*, 80*b* are pivoted upwardly and as the rails 80*a*, 80*b* are subsequently pivoted downwardly, the top board TB continues to be held against the rails 80*a* and 80*b* by the rollers 94 and 95 of the clamp roller assemblies 92 and 93. As previously stated, the assemblies 92 and 93 assure that the loops LP at the free end of the top board TB will be properly impaled by the smaller loops extending upwardly from the free end of the front side board FB. It is then possible to manually bend the loops extending from the front side board downwardly to interlock the front board and top board to complete the assembly of the box. To permit the folding rails 80*a*, 80*b* to be returned to their initial orientation, it is first necessary to actuate the cylinders 98 to outwardly pivot the rollers 94 and 95 from the ribs of the top board. Once this is done, the cylinders 74, 64 and 88 are again actuated so that the rails 80*a*, 80*b*, 56*a*, 56*b* and 68*a*, 68*b* will be returned to their original horizontal orientations in preparation for the next packaging operation.

To discharge the completed box assembly, the pistons of the cylinders 52 are then conjointly retracted to downwardly pivot the rail 42*b* and thereby lower the corner of the assembled box onto the continuously driven discharge conveyor 22. The discharge conveyor 22 then transfers the box to a take-away conveyor (not shown) which takes it to a stacking or loading mechanism for further handling.

The appropriate time sequential actuation of the cable cylinders 148 and 112 and the various hydraulic cylinders 166, 188*a*, 188*b*, 98, 64, 74, 88 and 52 can be accomplished by conventional limit switches (not shown) for defining the termination of the prescribed mechanical movements and by entirely conventional control circuitry (not shown) utilizing electromechanical relays and solenoids in the well known manner.

Although the best mode contemplated for carrying out the present invention has been herein shown and described, it will be apparent that modification and variation may be made without departing from what is regarded to be the subject matter of the invention.

What is claimed is:

1. An apparatus for packaging articles in a box assembly, wherein the box assembly includes a blank comprised of a top board, a bottom board, a first side board, and a second side board, all of said boards being foldably bound to each other, the box assembly further including a pair of separate end boards, said packaging apparatus comprising:

means for initially supporting the blank in a horizontal orientation;

platform means for receiving the articles and the end boards and for supporting the same in an arrangement such that the end boards are vertically positioned in a spaced relationship enclosing said articles and in a preassembled configuration suitable for placement on the bottom board of the blank;

means for moving said platform means with the end boards and articles thereon to a drop position directly above and aligned with the bottom board of the blank on said blank supporting means and for thereafter moving said platform means away from said bottom board along a horizontal path which is parallel to the blank;

means for selectively engaging the articles and end boards on said platform means as said platform means is moved in said horizontal path to strip the articles and end boards from said platform means and cause them to drop onto the bottom board of the blank;

means for upwardly folding the first and second side boards into vertical positions and for thereafter folding the top board downwardly to the first side board and into a horizontal position to encompass the articles and end boards within the folded blank; and means positioned above said folding means for pressing the end boards against the articles as the end boards and articles are supported on said platform means in said drop position directly above and aligned with the bottom board of the blank and for continuing to press the end boards against the articles in said preassembled configuration as they drop onto the bottom board and thereafter until the first and second side boards and said top board have been folded around said end boards by said folding means, whereby the free edges of the top board and first side board can be secured together to complete the assembly of a box with the articles packaged within.

2. The apparatus as set forth in claim 1 wherein said platform means includes a rectangular bottom wall and vertical side walls extending from the opposing side edges of the bottom wall.

3. The apparatus according to claim 1 wherein said means for pressing the end boards against the articles comprises a pair of opposed spaced clamp arms pivotally mounted for rotation inwardly toward each other, each of the clamp arms having a roller at its lower end adapted to rollably engage one of the end boards, and means for pivoting the clamp arms inwardly to press the rollers against the end boards and thereby press the end boards against said articles.

4. The apparatus according to claim 1 wherein said means for selectively engaging the end boards and articles on said platform means comprises an elongate plate having a length which is greater than the total transverse dimension of the end boards and articles, means for pivotally mounting said plate for rotation about an axis extending transversely of said path of travel of said platform means away from said bottom board, and means for pivoting said plate from an initial position such that the plate is elevated above the upper ends of said articles and end boards to a lowered position such that the plate abuts against the side edges of the end boards to thereby push the end boards and articles from the platform means as the platform means is moved in said horizontal path away from said bottom board.

5. The apparatus according to claim 1 wherein said blank supporting means comprises a plurality of pairs of spaced rail segments arranged to support the lateral edges of said first and second side boards and said top and bottom boards, said folding means comprising powered means arranged to pivot the respective pairs of opposed rail segments relative to the other pairs of opposed rail segments.

6. The apparatus according to claim 5 including a conveyor positioned beneath the pair of rail segments that support the bottom board for laterally transferring the completed box assembly from said apparatus, and means for downwardly pivoting one of said pair of rail segments from its initial box supporting position to a lowered position such that one end of the completed box assembly will be lowered onto said conveyor to permit the conveyor to discharge the completed box assembly.

7. The apparatus according to claim 1 further comprising reciprocating means for selectively feeding a box blank to said blank supporting means.

* * * * *